US009810043B1

(12) United States Patent
Bentley

(10) Patent No.: US 9,810,043 B1
(45) Date of Patent: Nov. 7, 2017

(54) SELF-SETTING CASING PROTECTOR

(71) Applicant: Richard Dewayne Bentley, Midland, TX (US)

(72) Inventor: Richard Dewayne Bentley, Midland, TX (US)

( * ) Notice: Subject to any disclaimer, the term of this patent is extended or adjusted under 35 U.S.C. 154(b) by 0 days.

(21) Appl. No.: 15/602,464

(22) Filed: May 23, 2017

Related U.S. Application Data

(60) Provisional application No. 62/342,654, filed on May 27, 2016.

(51) Int. Cl.

| | |
|---|---|
| ***B66C 1/00*** | (2006.01) |
| ***E21B 19/06*** | (2006.01) |
| ***E21B 41/00*** | (2006.01) |
| ***E21B 19/07*** | (2006.01) |

(52) U.S. Cl.
CPC ..... *E21B 41/0021* (2013.01); *E21B 19/07* (2013.01)

(58) Field of Classification Search
CPC ..... E21B 33/0422; E21B 19/10; E21B 19/07; E21B 19/06; E21B 19/14; E21B 41/0021; B66C 1/46; B66C 1/44
See application file for complete search history.

(56) References Cited

U.S. PATENT DOCUMENTS

| | | | | |
|---|---|---|---|---|
| 7,681,649 | B2 * | 3/2010 | Cerovsek | E21B 19/10 166/382 |
| 7,997,333 | B2 * | 8/2011 | Angelle | E21B 19/07 166/77.52 |
| 8,096,540 | B2 * | 1/2012 | Claxton | E21B 19/004 269/188 |
| 2004/0182611 | A1 * | 9/2004 | Ramey | E21B 19/10 175/423 |
| 2010/0059231 | A1 * | 3/2010 | Thomas | E21B 19/10 166/380 |

* cited by examiner

*Primary Examiner* — Stephen Vu
(74) *Attorney, Agent, or Firm* — Buskop Law Group, P.C.; Wendy Buskop

(57) ABSTRACT

A self-setting casing protector secured to a slip type casing elevator for grabbing a casing tubular and running the casing tubular into and out of a wellbore having two C-shaped setting plates each with a plurality of fastening holes; a plurality of support tubes positioned between aligned fastening holes; a plurality of bolts each penetrating pairs of fastening holes and a support tube, the second C-shaped setting plate simultaneously engaging (i) two aligned slip setting segments, and (ii) two aligned die retainers. As the slip type casing elevator is hoisted, the casing tubular drops while attached to the first C-shaped setting plate setting the casing tubular in the slip type casing elevator while simultaneously (i) protecting each casing tubular as it is sequentially lowered into or pulled from the wellbore, and (ii) protecting an upsetting box with premium connections as the tubular is run into and out of a wellbore.

10 Claims, 4 Drawing Sheets

SELF-SETTING CASING PROTECTOR

CROSS REFERENCE TO RELATED APPLICATIONS

The present application claims priority to and the benefit of U.S. Provisional Patent Application Ser. No. 62/342,654 filed on May 27, 2016, entitled "SELF-SETTING CASING PROTECTOR". This reference is hereby incorporated in its entirety.

FIELD

The present embodiment relates to a self-setting casing protector.

BACKGROUND

A need exists for an assembly of a self-setting casing protector for slip type elevators that avoids the need for rig hands to be on the drilling floor during the makeup of a casing string.

The present embodiments meet these needs.

BRIEF DESCRIPTION OF THE DRAWINGS

The detailed description will be better understood in conjunction with the accompanying drawings as follows.

Figure 1:
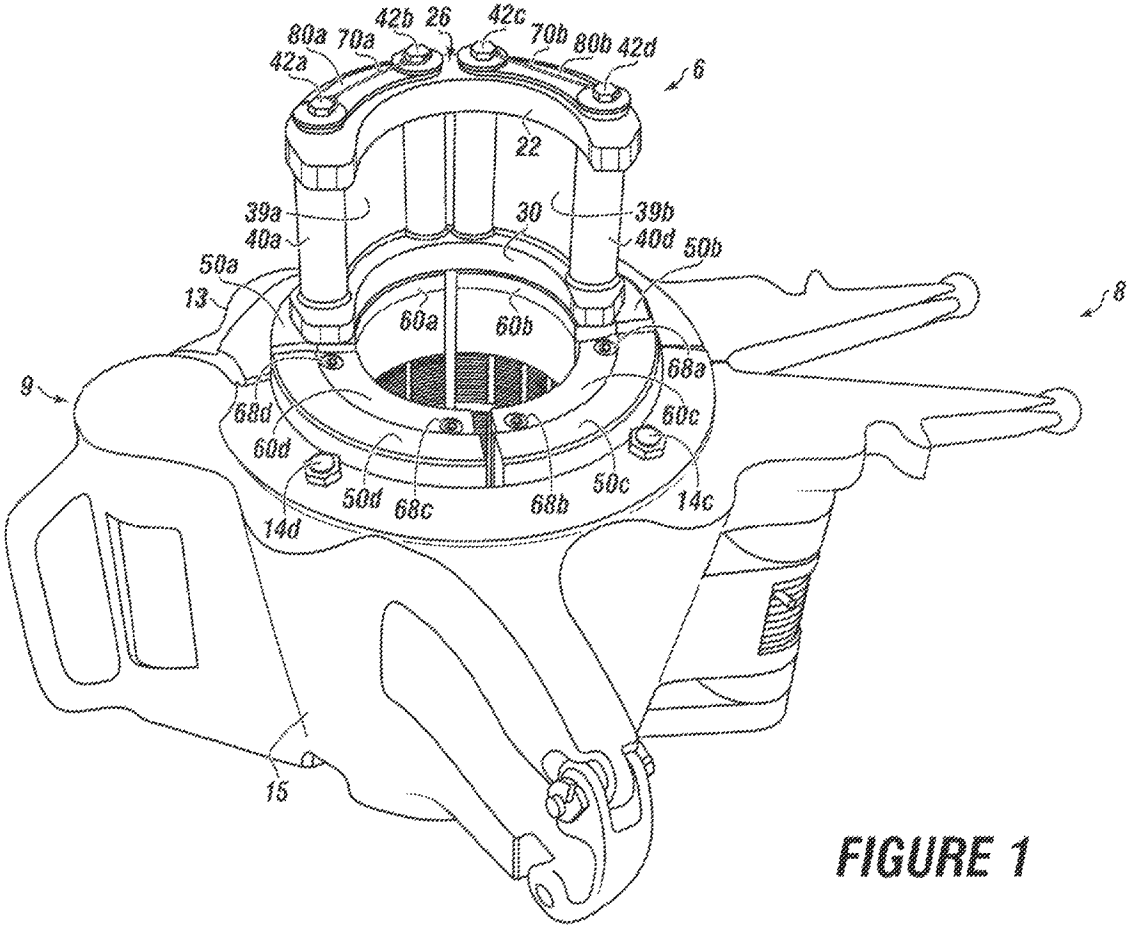
FIG. 1 is a perspective view of a self-setting casing according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a self-setting casing protector secured to a slip type casing elevator.

The invention is a self-setting casing protector secured to a slip type casing elevator having a housing with a first segment and a second segment. The housing is confirmed to operate between an open configuration and a closed configuration for grabbing a casing tubular and running the casing tubular into and out of a wellbore.

The self-setting casing protector comprises a first C-shaped setting plate with a top side and a first taper formed on a first end with a plurality of first fastening holes formed through the first C-shaped setting plate.

A second C-shaped setting plate with a bottom side and a second taper is formed on a second end with a plurality of second fastening holes formed through the second C-shaped setting plate, the second end opposite the first end.

A plurality of support tubes are positioned over the plurality of first fastening holes. The support tubes connect the first C-shaped setting plate and the second C-shaped setting plate as a one piece integral unit.

A self-setting casing protector has a plurality of bolts, wherein each bolt penetrates sequentially one first fastening hole of the plurality of first fastening holes, one support tube of the plurality of support tubes and one second fastening hole of the plurality of second fastening holes.

The second C-shaped setting plate of the self-setting casing protector simultaneously engages (i) two aligned slip setting segments. Each aligned slip setting segment is mounted on a segment of the slip type casing elevator and (ii) two aligned die retainers.

The first C-shaped setting plate engages a nubbin in one end of a casing tubular as the slip type casing elevator grabs a casing tubular, and as the slip type casing elevator is hoisted, the casing tubular drops while attached to the first C-shaped setting plate setting the casing tubular in the slip type casing elevator and simultaneously (i) protecting from impacts each casing tubular as each casing tubular is sequentially lowered into the wellbore, (ii) protecting an upsetting box of a casing tubular with premium connections as the casing tubular is run into and out of a wellbore, and (iii) protecting from impacts each casing tubular as each casing tubular is sequentially pulled from the wellbore.

Benefits

The self-setting casing protector saves lives because no derrick man has to be sent up into the derrick to attach the elevator to the hoist. This prevents loose pipe from severely injuring the derrick man.

The self-setting casing protector stops environmental spills by preventing the casing from being crushed and leaking and causing well failure down the road.

The self-setting casing protector prevents fires at the well surface by providing the protection that stops crushing of the pipe that prevents fires as steel is pulled from the wellbore by preventing volatile gases from igniting when the steel sparks.

The self-setting casing protector enables casing to be installed or removed from the well at least 25 percent faster as compared to non-protected elevators. With this self-setting casing protector, 80 joints an hour can be run, and without the self-setting casing protecting only 40 joints an hour would be run.

A benefit of the invention is no pneumatic compressor is needed; no extra energy is needed to push the pipe downhole.

In embodiments, the self-setting casing protector can comprise a plurality of neoprene rubber sleeves. Each neoprene rubber sleeve of the plurality of neoprene rubber sleeves is installed in one support tube of the plurality of support tubes, the plurality of first fastening holes, the plurality of second fastening holes, or a combination thereof.

In embodiments, the self-setting casing protector can comprise a curved support plate mounted between the first C-shaped setting plate and the second C-shaped setting plate. The curved support plate is engaged with the first C-shaped setting plate and the second C-shaped setting plate as a one piece integral unit.

In embodiments, the self-setting casing protector can comprise a plurality of face plates. Each face plate of the plurality of face plates is mounted between the first C-shaped setting plate and the second C-shaped setting plate. Each face plate of the plurality of face plates has a curved shape. Each face plate of the plurality of face plates engages with the C-shape setting plates as a one piece integral unit.

In embodiments, each die retainer can have an outer side, which slides over the inner portion of the nonaligned slip setting segment and can attach to the inner portion with elevator fasteners through die holes through a top side of the die retainer.

In embodiments, a plurality of support plates can be mounted between pairs of support tubes.

In embodiments, each support plate can be curved and connect the first and second C-shaped setting plates as a one piece integral unit In embodiments, the plurality of die retainers of the slip type casing elevator can hold slip dies in place with slip fasteners.

DEFINITIONS

The following terms are used herein:

The term "bolt aligner plates" refers to one of a plurality of bolt aligner plates mounted between a pair of bolts on the top side of the first C-shaped setting plate.

The term "closed configuration" refers to the casing elevator once it has been completely closed.

The term "C-shaped setting plate" refers to two plates aligned with each other, having columns in between the first plate and the second plate to make a one piece integral unit.

The term "curved support plate" refers to a plate mounted between the first C-shaped setting plate and the second C-shaped setting plate. The curved support plate engages with the first C-shaped setting plate and the second C-shaped setting plate as a one piece integral unit.

The term "die retainers" refers to parts of the elevator that captures elevator dies.

The term "face plate" refers to one of a plurality of face plates mounted between the first C-shaped setting plate and the second C-shaped setting plate. Each face plate has either straight or a curved shape.

The term "rubber sleeves" refers to one of a plurality of neoprene rubber sleeves installed in one support tube of the plurality of support tubes.

The term "nubbin" refers to a casing lifting device.

The term "one piece integral unit" refers to a complete casing protector assembly.

The term "open configuration" refers to the unobstructed side that allows casing to enter.

The term "safety wires" refers to one of a plurality of safety wires connected between a pair of fasteners that are secured safely.

The term "slip type casing elevator" refers to a casing elevator that utilizes slip inserts to securely clamp to the casing for lifting and lowering into well bore.

The term "support tubes" refers to steel tubes separating upper and lower setting plates allowing fasteners thru complete assembly.

The term "taper" refers to beveled edges of setting plates allowing casing entry into tool minimizing interference.

The term "an upsetting box" refers to female thread end of casing with larger diameter than casing pipe.

Turning now to the Figures, FIG. 1 is a perspective view of a self-setting casing protector 6 according to one or more embodiments.

The self-setting casing protector can engage a slip type casing elevator 8 for grabbing casing tubular and running casing tubular into and out of a wellbore during wellbore operations. The slip type casing elevator can have a housing 9. The housing can have a first segment 13 that is pivotally connected to a second segment 15, allowing the slip type casing elevator 8 to have an open and a closed configuration.

The self-setting casing protector 6 can be configured to move in opposite directions along a longitudinal axis of the slip type casing elevator and can be contained at least partially within groups of slip dies of the slip type casing elevator.

The self-setting casing protector 6 can attach to only one segment of the housing, either the first segment 13 or the second segment 15 via preexisting fastening holes in a slip type casing elevator 8.

The self-setting casing protector can have a first C-shaped setting plate 22. The first C-shaped setting plate 22 has a top side 26. Also, self-setting casing protector having a second C-shaped setting plate 30. The second C-shaped setting plate 30 has a bottom side 34. The first and second C-shaped setting plates are aligned with a taper on each end of the first and second C-shaped setting plates and are on opposite ends of each other.

A plurality of support tubes 40*a*-40*d* can be positioned over a fastening hole in each C-shaped setting plate. The support tubes can connect the first and second C-shaped setting plates as a one piece integral unit.

A plurality of optional support plates 39*a* and 39*b* can be mounted between pairs of support tubes. Each support plate can be curved and connect the first and second C-shaped setting plates as a one piece integral unit.

A plurality of bolts 42*a*-42*d* are shown. Each bolt can penetrate one first fastening hole, one support tube and one second fastening hole.

A plurality of safety wires 70*a* and 70*b* are shown in this Figure. Safety wire 70*a* can connects a pair of bolts 42*a* and 42*b*, and safety wire 70*b* connects a pair of bolts 42*c* and 42*d*.

The self-setting casing protector 6 of this Figure is shown with a plurality of bolt aligner plates 80*a* and 80*b*. Each bolt aligner plate can be mounted between a pair of bolts on the top side 26 of the first C-shaped setting plate 22.

The self-setting casing protector 6 of this FIG. 1 is shown attached to two aligned slip setting segments 50*a* and 50*b* of a slip type casing elevator with four slip setting segments 50*a*-*d*.

The self-setting casing protector can be reoriented and moved to attached to different slip setting segments, such as slip setting segments 50*c* and 50*d* leaving slip setting segments 50*a* and 50*b* non-aligned slip setting segments.

In this invention, two slip setting segments of the plurality of slip setting segments are aligned slip setting segments. In this Figure, elements 50*a* and 50*b* are aligned slip setting segments and mounted between one group of slip dies of the slip type casing elevator 8 and the second C-shaped setting plate.

A plurality of die retainers 60*a*-60*d* are shown. The die retainers of the slip type casing elevator 8 can hold the slip dies in place. In this Figure, die retainers 60*a* and 60*b* are aligned slip type die retainers.

Slip fasteners 14*a*-14*d* are depicted. The slip fasteners can hold the slip setting segments 50*a*-50*d* into the slip type elevator.

Each die retainer can form a locking engagement with one of the slip setting segments. Elevator fasteners 68*a*-68*d* engage an opening formed in the die retainers.

In embodiments, the self-casing protector has a height from five inches to 8½ inches and a width from 11 inches to 11⅝ inches.

Figures 2, 3, 4:
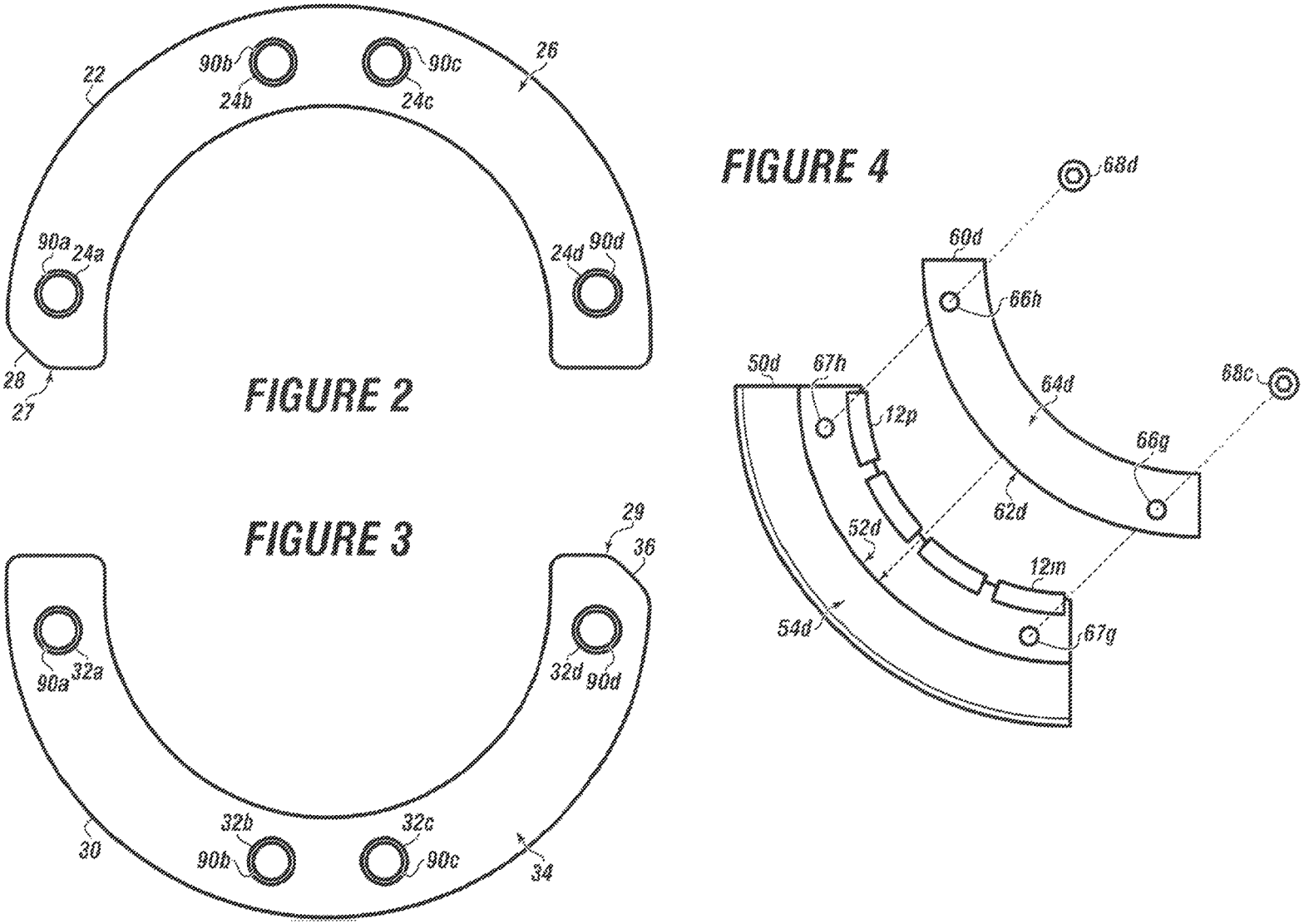
FIG. 2 is a top view of a first C-shaped setting plate, according to one or more embodiments.
FIG. 3 is a top view of a second C-shaped setting plate, according to one or more embodiments.
FIG. 4 is a top view of one of the plurality of slip setting segments according to one or more embodiments.

FIG. 2 depicts the first C-shaped setting plate 22 with a top side 26 and a first taper 28 formed on a first end 27.

FIG. 2 shows a first C-shaped setting plate having a plurality of first fastening holes 24*a*-24*d* formed through the first C-shaped setting plate 22.

A plurality of neoprene rubber sleeves 90*a*-90*d* are depicted. Each neoprene rubber sleeve can be installed through the fastening holes, the casing tubular or a combination thereof.

FIG. 3 is a top view of the second C-shaped setting plate 30.

The second C-shaped setting plate 30 is shown with a bottom side 34 and a second taper 36 formed on a second end 29, with a plurality of second fastening holes 32*a*-32*d* formed through the second C-shaped setting plate.

The plurality of neoprene rubber sleeves 90*a*-90*d* are shown, one in each of the fastening holes, the tubular casing, or a combination thereof.

The second end 29 of the second C-shaped setting plate is depicted opposite and not in alignment with the first end of the first C-shaped setting plate 22.

In embodiments, the first C-shaped setting plate and second C-shaped setting plate can have an inside diameter from 4 to 8 inches.

FIG. 4 is a top view of one of the plurality of slip setting segments according to one or more embodiments.

In FIG. 4, one setting segments of the plurality of slip setting segments 50*d* is shown as it engages one die retainers of the plurality of die retainers 60*d* of the slip type casing elevator.

The slip setting segment 50*d* can have two portions, an inner portion with an inner surface 52*d*, and an outer portion. Both inner and outer portions are integrally connected together. In embodiments, the slip setting segment 50*d* has a top side 54*d* that engages the second C-shaped setting plate.

This Figure depicts a group of slip dies, 12*m*-12*p* that can engage each inner surface of the inner portion of the slip setting segment 50*d*.

In embodiments, each slip setting segment may contain between 2 to 6 slip dies.

Fasteners 67*g* and 67*h* are shown holding the inner portion to the slips.

This Figure also shows a die retainer 60*d* having an outer side 62*d* that can slide over the inner portion of the slip setting segment 50*d* and can attach to the inner portion with elevator fasteners 68*d* and 68*c* through die holes 66*h* and 66*g* through a top side 64*d* of the die retainer 60*d*.

It should be noted that each outer side of a die retainer can form a locking engagement with one of the inner surfaces of one of the slip setting segments.

Figure 5:
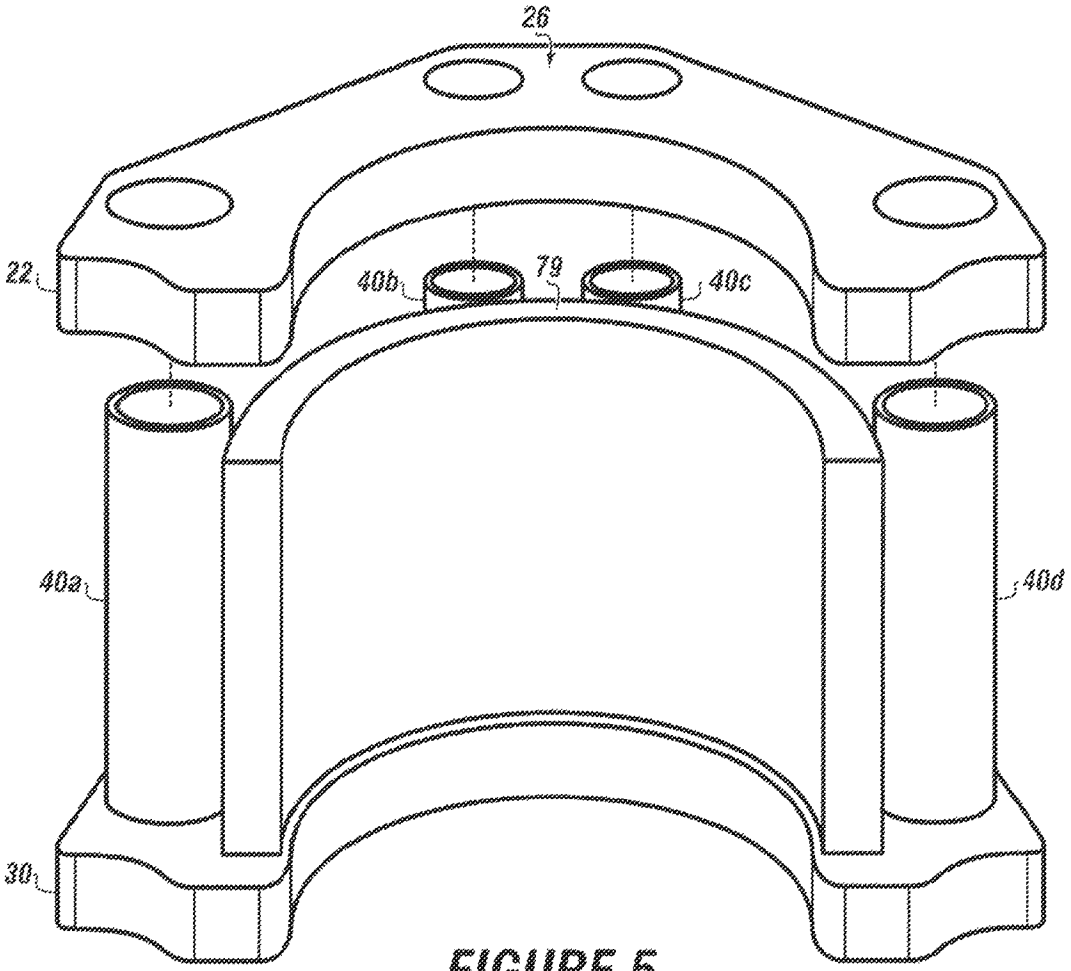
FIG. 5 depicts a curved support plate according to one or more embodiments.

FIG. 5 shows an embodiment with a curved support plate 79 mounted between the first C-shaped plate 22 and the second C-shaped setting plate 30. The curved support plate 79 can engage with the top side 26 and the C-shaped setting plates as a one piece integral unit, which can include support tubes 40*a*-40*d*.

In embodiments, the support plates can have a thickness from ½ inch to one inch.

Figure 6:
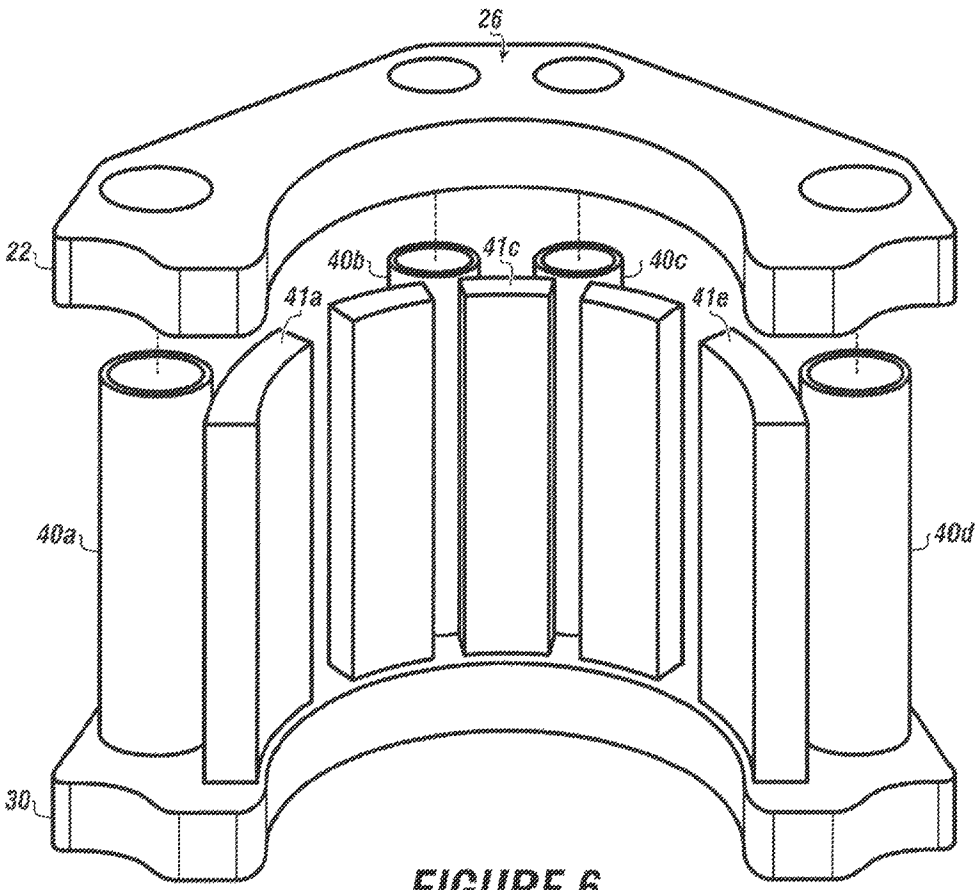
FIG. 6 is a perspective view with a plurality of face plates according to one or more embodiments.

FIG. 6 shows an embodiment with a plurality of face plates 41*a*-41*e* mounted between the first C-shaped plate 22 on a side opposite the top side 26 and the second C-shaped setting plate 30. The face plates can engage with the C-shaped setting plates as a one piece integral unit and can include support tubes 40*a*-40*d*.

In embodiments, the self-setting casing protector has a plurality of safety wires. Each safety wire of the plurality of safety wires can be connected between a pair of bolts.

In embodiments, the self-setting casing protector has a plurality of bolt aligner plates. Each bolt aligner plate can be mounted between a pair of bolts on the top side of the first C-shaped setting plate.

In embodiments, the self-setting casing protector can have a plurality of neoprene rubber sleeves. Each neoprene rubber sleeve of the plurality of neoprene rubber sleeves can be installed in one support tube of the plurality of support tubes. Each neoprene rubber sleeve can be installed through the plurality of first fastening holes, the plurality of second fastening holes, or a combination thereof.

In embodiments, the self-setting casing protector can use a curved support plate mounted between the first C-shaped setting plate and the second C-shaped setting plate.

The curved support plate can engage with the first C-shaped setting plate and the second C-shaped setting plate as a one piece integral unit.

In embodiments, the self-setting casing protector utilizes a plurality of face plates.

Each face plate of the plurality of face plates can be mounted between the first C-shaped setting plate and the second C-shaped setting plate.

Each face plate of the plurality of face plates can have a curved shape.

Each face plate of the plurality of face plates engages with the C-shape setting plates as a one piece integral unit.

The face plate can have a height from three inches to four inches, a length from four inches to 5¼ inches and a width of ½ inch to ¾ inch.

In embodiments, the self-setting casing protector can use die retainers that each have an outer side that can slide over the inner portion of the non-aligned slip setting segment and can attach to the inner portion with elevator fasteners through die holes penetrating through a top side of the die retainer.

In embodiments, the self-setting casing protector can have a plurality of support plates can be mounted between pairs of support tubes.

In embodiments, each support plate can be is curved and connect the first and second C-shaped setting plates as a one piece integral unit.

In embodiments, the self-setting casing protector can have a plurality of die retainers of the slip type casing elevator to hold slip dies in place with slip fasteners.

In operation, the first C-shaped setting plate can engage a nubbin in one end of a casing tubular. When the slip type casing elevator is hoisted, casing tubular drops while attached to the first C-shaped setting plate. The dropping motion sets the casing tubular in the slip type casing elevator according to one or more embodiments.

In embodiments, the slip type casing elevator with attached self-setting casing protector is secured to the casing tubular until the casing tubular can be lowered into the wellbore. Once in the wellbore, the slip setting segments of the slip type casing elevator can be set and the load can then be released.

In embodiments, the slip type casing elevator can grab another casing tubular and can repeat the sequence for any number of casing tubulars needing to be run down hole. Operationally, the steps can be reversed to remove casing tubular from a wellbore.

In a self-setting casing protector, the slip type casing elevator can grab or as the oil industry indicates can "bite" the casing tubular on the pipe portion, rather than an upsetting box where premium connections occur. A self-setting casing protector can allow casing tubular to be lifted out of the wellbore and placed into a troft and lowered to pipe rack or on the ground with less damage.

EXAMPLE 1

A self-setting casing protector secured to a slip type casing elevator such as an HYC type casing elevator having a housing made from cast steel. The housing configured to operate between an open configuration and a closed configuration of for grabbing a casing tubular and running the casing tubular into and out of a wellbore.

The self-setting casing protector having first C-shaped setting plate that has an inside diameter of 4¼ inches with first taper that tapers to a face formed on a first end with two fastening holes formed through the first C-shaped setting plate.

The self-setting casing protector can have a second C-shaped setting plate that has an inside diameter of 4¼ inches and a second taper formed on a second end that tapers to a face. The second C-shaped plate having a plurality of second fastening holes formed through the second C-shaped setting plate. The second end is opposite the first end.

In this Example, two support tubes are used. Each support tube would be 5¼ inches with a diameter of 1.660 inches. Each support tube positioned over the first fastening holes. The support tubes connect the first C-shaped setting plate and the second C-shaped setting plate as a one piece integral unit.

Two fasteners that can be bolts are used to penetrate sequentially one first fastening hole of the plurality of first fastening holes. One support tube of the plurality of support tubes and one second fastening hole of the plurality of second fastening holes.

The second C-shaped setting plate of the self-setting casing protector engages the two slip setting segments mounted on two segments of the slip type casing elevator, and two die retainers simultaneously, wherein the first C-shaped setting plate engages a nubbin in one end of a casing tubular as the slip type casing elevator grabs a casing tubular, after the casing tubular is lowered into the wellbore. The slip type casing elevator releases the casing tubular, enabling the self-setting casing protector to grab another casing tubular, and repeating the sequence for any number of casing tubulars needing to be run down hole while protecting an upsetting box of a casing tubular with premium connections as the casing tubular is run into and out of the wellbore.

EXAMPLE 2

A self-setting casing protector secured to a slip type casing elevator such as an MYC type casing elevator having a housing made from cast steel. The housing configured to operate between an open configuration and a closed configuration for grabbing a casing tubular and running the casing tubular into and out of a wellbore.

The self-setting casing protector having first C-shaped setting plate that has an inside diameter of 7⅞ inches with first taper that tapers to a face formed on a first end with a four fastening holes formed through the first C-shaped setting plate.

The self-setting casing protector can have a second C-shaped setting plate has an inside diameter of 7⅞ inches and a second taper formed on a second end that tapers to a face. The second C shaped plate having a plurality of second fastening holes formed through the second C-shaped setting plate, the second end opposite the first end.

In this Example, four support tubes are used. Each support tube would be 5¼ inches with a diameter of 1.660 inches. Each support tube is positioned over the first fastening holes. The support tubes connect the first C-shaped setting plate and the second C-shaped setting plate as a one piece integral unit.

Four fasteners, such as hex bolts, are used to penetrate sequentially one first fastening hole of the plurality of first fastening holes, one support tube of the plurality of support tubes, and one second fastening hole of the plurality of second fastening holes.

The second C-shaped setting plate of the self-setting casing protector engages the two slip setting segments mounted on two segments of the slip type casing elevator and two die retainers simultaneously, wherein the first C-shaped setting plate engages a nubbin in one end of a casing tubular as the slip type casing elevator grabs a casing tubular. After the casing tubular is lowered into the wellbore, the slip type casing elevator releases the casing tubular, enabling the self-setting casing protector to grab another casing tubular, and repeating the sequence for any number of casing tubulars needing to be run down hole while protecting an upsetting box of a casing tubular with premium connections as the casing tubular is run into and out of the wellbore.

EXAMPLE 3

A self-setting casing protector secured to a slip type casing elevator such as an YC type casing elevator having a housing made from cast steel. The housing configured to operate between an open configuration and a closed configuration for grabbing a casing tubular and running the casing tubular into and out of a wellbore.

The self-setting casing protector having first C-shaped setting plate that has an inside diameter of 5¾ inches with the first taper that tapers to a face formed on a first end with two fastening holes formed through the first C-shaped setting plate.

The self-setting casing protector can have a second C-shaped setting plate that that has an inside diameter of 5¾ inches and a second taper formed on a second end that tapers to a face. The second C-shaped plate having a plurality of second fastening holes formed through the second C-shaped setting plate. The second end is opposite the first end.

In this Example, two support tubes are used. Each support tube would be 5¼ inches with a diameter of 1.660 inches. Each support tube positioned over the first fastening holes. The support tubes connect the first C-shaped setting plate and the second C-shaped setting plate to form a complete one piece integral unit.

Two fasteners that can be bolts are used to penetrate sequentially one first fastening hole of the plurality of first fastening holes. One support tube of the plurality of support tubes and one second fastening hole of the plurality of second fastening holes.

The second C-shaped setting plate of the self-setting casing protector engages the two slip setting segments mounted on two segments of the slip type casing elevator and two die retainers simultaneously, wherein the first C-shaped setting plate engages a nubbin in one end of a casing tubular as the slip type casing elevator grabs a casing tubular. After the casing tubular is lowered into the wellbore, the slip type casing elevator releases the casing tubular, enabling the self-setting casing protector to grab another casing tubular and repeating the sequence for any number of casing tubulars needing to be run down hole while protecting an upsetting box of a casing tubular with premium connections as the casing tubular is run into and out of the wellbore.

While these embodiments have been described with emphasis on the embodiments, it should be understood that within the scope of the appended claims, the embodiments might be practiced other than as specifically described herein.

What is claimed is:

1. A self-setting casing protector secured to a slip type casing elevator having a housing with a first segment and a second segment, the housing confirmed to operate between an open configuration and a closed configuration for grabbing a casing tubular and running the casing tubular into and out of a wellbore, the self-setting casing protector comprising:

(i) a first C-shaped setting plate with a top side and a first taper formed on a first end with a plurality of first fastening holes formed through the first C-shaped setting plate;

(ii) a second C-shaped setting plate with a bottom side and a second taper formed on a second end with a plurality of second fastening holes formed through the second C-shaped setting plate, the second end opposite the first end;

(iii) a plurality of support tubes, each support tube positioned over the plurality of first fastening holes, the plurality of support tubes connecting the first C-shaped setting plate and the second C-shaped setting plate as a one piece integral unit;

(iv) a plurality of bolts, each bolt penetrating sequentially one of the plurality of first fastening holes, one support tube of the plurality of support tubes and one fastening hole of the plurality of second fastening holes;

wherein the second C-shaped setting plate of the self-setting casing protector simultaneously engages (i) two aligned slip setting segments, each aligned slip setting segment mounted on a segment of the slip type casing elevator and (ii) two aligned die retainers; and wherein the first C-shaped setting plate engages a nubbin in one end of a casing tubular as the slip type casing elevator grabs a casing tubular, and as the slip type casing elevator is hoisted, the casing tubular drops while attached to the first C-shaped setting plate setting the casing tubular in the slip type casing elevator and simultaneously (i) protecting from impacts each casing tubular as each casing tubular is sequentially lowered into the wellbore, (ii) protecting an upsetting box of a casing tubular with premium connections as the casing tubular is run into and out of a wellbore, and (iii) protecting from impacts each casing tubular as each casing tubular is sequentially pulled from the wellbore.

2. The self-setting casing protector of claim 1, comprising a plurality of safety wires, each safety wire of the plurality of safety wires connected between a pair of bolts.

3. The self-setting casing protector of claim 1, comprising a plurality of bolt aligner plates, each bolt aligner plate mounted between a pair of bolts on the top side of the first C-shaped setting plate.

4. The self-setting casing protector of claim 1, comprising a plurality of neoprene rubber sleeves, each neoprene rubber sleeve of the plurality of neoprene rubber sleeves installed in one support tube of the plurality of support tubes, the plurality of first fastening holes, the plurality of second fastening holes, or a combination thereof.

5. The self-setting casing protector of claim 1, comprising a curved support plate mounted between the first C-shaped setting plate and the second C-shaped setting plate, the curved support plate engaged with the first C-shaped setting plate and the second C-shaped setting plate as the one piece integral unit.

6. The self-setting casing protector of claim 1, comprising a plurality of face plates, each face plate of the plurality of face plates mounted between the first C-shaped setting plate and the second C-shaped setting plate, each face plate of the plurality of face plates having a curved shape, each face plate of the plurality of face plates engaging with the C-shape setting plates as the one piece integral unit.

7. The self-setting casing protector of claim 1, wherein each die retainer has an outer side, which slides over the inner portion of the nonaligned slip setting segment and attaches to the inner portion with elevator fasteners through die holes through a top side of the die retainer.

8. The self-setting casing protector of claim 1, wherein a plurality of support plates are mounted between pairs of support tubes.

9. The self-setting casing protector of claim 8, wherein each support plate is curved and connects the first and second C-shaped setting plates as the one piece integral unit.

10. The self-setting casing protector of claim 1, wherein the plurality of die retainers of the slip type casing elevator hold slip dies in place with slip fasteners.

* * * * *